US005243789A

United States Patent [19]

Bacic

[11] Patent Number: 5,243,789

[45] Date of Patent: Sep. 14, 1993

[54] PULPSTONE

[75] Inventor: Dan D. Bacic, Stoney Creek, Canada

[73] Assignee: Norton Company, Worcester, Mass.

[21] Appl. No.: 644,670

[22] Filed: Jan. 23, 1991

Related U.S. Application Data

[63] Continuation-in-part of Ser. No. 427,430, Oct. 27, 1989, abandoned.

[51] Int. Cl.[5] ..... B23F 21/03

[52] U.S. Cl. ..... 51/206 R; 51/206.5

[58] Field of Search ..... 51/200 R, 206.4, 206.5, 51/206 NF, 206 P

[56] References Cited

U.S. PATENT DOCUMENTS

| | | | |
|---|---|---|---|
| 933,603 | 9/1909 | Wagg | 51/206.5 |
| 1,865,523 | 7/1932 | Jeppson | 51/206.5 |
| 2,369,639 | 2/1945 | Ball et al. . | |
| 2,453,748 | 11/1948 | Fisher | 51/206.5 X |
| 2,887,276 | 5/1959 | Minarik . | |
| 3,277,611 | 10/1966 | Cook | 51/206.4 |
| 4,351,486 | 9/1982 | Schmoller et al. . | |

*Primary Examiner*—M. Rachuba

*Attorney, Agent, or Firm*—Arthur A. Loiselle, Jr.

[57] ABSTRACT

A segmental grinding stone, particularly a pulpstone, wherein the segments are assembled to a ring or central support portion through a bolt which passes through a recessed hole in the face of the segment and screws into a nut means.

4 Claims, 1 Drawing Sheet

PULPSTONE

This is a continuation-in-part of application Ser. No. 07/427,430 filed Oct. 27, 1989, now abandoned.

TECHNICAL FIELD

This invention relates to an improved pulpstone or grinding wheel having an abrasive periphery that is filled with a concrete core and the method of making the pulpstone. More particularly it is concerned with a novel structure for holding the abrasive segments of a pulpstone together whereupon they are then used as a form for molding the concrete core that is poured into the assembled annulus of segments for completing the attachment of the segments to the periphery of the core.

BACKGROUND AND INFORMATION DISCLOSURE STATEMENT

The following U.S. Patents are representative of the most relevant prior art known to the applicant at the time of the filing of this application.

| U.S. Pat. Nos. | | |
|---|---|---|
| 933,603 | Wagg | September 7, 1909 |
| 2,369,639 | Ball et al. | February 20, 1945 |
| 2,453,748 | Fisher et al. | November 16, 1948 |
| 2,887,276 | Minarik | May 19, 1959 |
| 4,351,486 | Schmoller et al. | September 28, 1982 |

The conventional pulpstone is usually made by assembling a plurality of abrasive segments that are then filled with a concrete core whereby to form an abrasive periphery integral with a central core made of concrete, or in some instances it has been proposed to assemble such segments on the periphery of another form of a rigid body like a cylindrical metal annulus. The segments are frequently provided with integral studs extending radially inwardly toward the center of the pulpstone, which segments are assembled together with a concrete core by means of these studs being bolted to the reinforcing cage of the concrete core, the studs subsequently becoming permanently bonded and sealed within the center core.

The patent to Fisher et al. is of general interest only in showing an abrasive grinding wheel for the surface finishing of glass plates wherein the grinding wheel means is constructed with abrasive segments bolted to a circular supporting ring means. The grinding wheel of this disclosure utilizes the exposed ends of the segments for grinding the glass sheet being polished as distinguished from the periphery of the wheel as with a pulpstone used for grinding logs to make a wood pulp. As the segments of the glass plate grinding means wear down, the successive rings that support the segments may be removed to provide a continuing support for the remaining portions of the abrasive segments forming the wheel.

The remaining patents cited above all show grinding wheels for use in making wood pulp. Wagg and Minarik each show a bolting arrangement for attaching a plurality of abrasive elements to a centrally disposed metal cylinder or ring. The Wagg patent teaches the use of a molten filler flowed into place between the segments and the mounting means therefore to preclude any movement of the segments relative to it's metal support ring when the wheel is in use. The Minarik disclosure uses an eye-bolt with each segment, the eye-bolt being carried on a crossrod that passes through the center of each of the individual segments of a pulpstone to fasten the individual segments to the surface of a cylindrical cast iron drum. In this construction the individual segments are mounted on the drum with spaces between all sides of the individual segments to make passages available for the circulation of a fluid from the cylinder through the spaces to the grinding surface of the stone to assist in the grinding process.

Ball et al. provides a wheel wherein a unitary solid annulus constitutes the grinding element of a pulpstone, as distinguished from a pulpstone fabricated with a plurality of individual segments assembled together on the periphery of the grinding stone to form the grinding surface of the pulpstone structure. This Ball et al. disclosure provides for the attachment of the annulus to a metal ring positioned concentrically within the annulus and threaded spokes that have one end integrally attached to the respective side walls of the annulus that are used to tension the annulus around the metal ring to prestress the abrasive ring against the stresses produced by the grinding process. The central opening in the Ball et al. annulus is filled with concrete after the annulus has been mounted on the metal ring and the nuts 11 by which the tension in each of the respective spokes is adjusted then become permanently sealed within the concrete core.

Schmoller et al. disclose several systems for mounting abrasive segments on the periphery of pulpstones. In FIGS. 1–5 a very general disclosure sets forth a bolting arrangement for supporting such segments on a concrete core and in FIGS. 6–11 the segments are shown mounted on a steel ring or cylinder. In each instance the segments are each provided with nut means situated within the segments that are simply threaded onto bolts extending outwardly from a support cylinder to hold the several segments onto their support means, there being no detailed discussion of the particulars of the bolting system except as the bolt structures are modified to promote the circulation of water to the surface of the pulpstones through the segments which are made somewhat porous or are spaced apart to permit the water to flow outwardly to the surface of the pulpstone.

BRIEF DESCRIPTION OF THIS INVENTION

An improved bolting arrangement and method of completing the assembly of a pulpstone is shown herein for mounting a plurality of abrasive segments on the periphery of a pulpstone. The invention is concerned with the mounting of the individual segments on the concrete core of an otherwise conventional type of such pulpstones and makes use of the internal reinforcing means of the core for supporting the segments.

In the practice of this invention, the plurality of segments that are to be carried on the periphery of the stone, are formed into an annular or a circular assembly of the segments that resembles a "chimney". This chimney is constructed by first using a number of appropriately shaped abrasive segments to form a ring or circular assembly and then another circular assembly of the segments is built up on the first ring and so forth to finally assemble all of the segments into the cylindrical chimney of a desired height. Then certain of the reinforcing rings for the concrete core that is to be subsequently poured into the chimney and cured to form the support core for the segments, are fitted concentrically within the chimney.

Each one of the several segments in the chimney are provided with a plurality of bolt holes extending from their grinding surfaces radially inwardly to receive bolt means. The shape of the seating means or bottom of the hole is of a special design; it is round, i.e. concave, or in the shape of a cone, i.e. non-flat. FIGS. 1 and 3 show the configuration of the bottom of the wide part of the hole as round. The bolt 18 in FIG. 1 passes upwardly through the lower narrow section 20 of the hole and into the wider upper section 14. Each bolt 18 and hole is fitted with a hemispherical washer 32, a straight washer 30, both made of mild steel, and a compressible and resilient gasket 31 which is composed of a polymeric material such as polycarbonate, acrylonite-butadienestyrene, such as polytetrafluoroethylene, cork filled rubber, nylon, polyethylene polypropylene, or the like, located between the straight washer 30 and the hemispherical washer 32. Obviously if the bottom of the hole was cone shaped, then the washer 32 would also be cone shaped. The shank of the bolt extends radially inwardly so that the inner end of the bolt can be supported from the reinforcing rings.

It is the aforedescribed combination of non-flat i.e. round or cone-shaped hole, hemi-spherical or cone-shaped washer, and compressible gasket, which results in the virtual elimination of segment loss. This novel hole shape and attachment means has the result that pocket pressures do not cause any compression in the attachment bolts and therefore do not create any stress concentrations. Pocket pressures actually reduce the amount of tension stress in the attachment bolt which improves the performance of the attachment.

After the chimney has been built and the bolt and nut means have been assembled together with the reinforcing rings and drawn up to the proper tension, the remaining reinforcing structure is built up within the center of the chimney and the concrete is poured into the mold thus formed. When the concrete is cured the wheel structure may be finished.

The preliminary molding of the green segments with the holes for the bolts for securing the segments to the reinforcing rings makes it possible to improve the firing process for the initial fabrication of the segments themselves. The production of a finished segment with such bolt holes also simplifies the assembly process for completing the wheel structure. Since the green molded segments are processed with a plurality of bolt holes extending entirely through the mass of the segment, when the abrasive grains and the bond mixture for the segments is fired to produce the ultimate abrasive segment, the burn can be completed in a shorter time and with the expectation that a better quality of product will result since the heat to cure the segment can blow more rapidly and evenly throughout the mass being fired. As will be made more fully evident from the discussion below, these fired segments can be more easily and quickly assembled together with the reinforcing rings of the core means as compared with the procedure heretofore required to complete the assembly of conventional pulpstones and with a saving in time needed for the production of the known product.

IN THE DRAWINGS

DESCRIPTION OF THE PREFERRED EMBODIMENTS

The present invention is concerned with the mounting of a plurality of abrasive segments on the periphery of the more popular types of pulpstones having a concrete core generally similar to the structures shown in the above mentioned patents to Minarik and Schmoller et al., FIGS. 1–5. Such pulpstones are cylindrical in shape and may have a diameter falling within a range of from 50" to 75" or more and a length of from 27" to 90" or more. The present invention makes use of a poured center core of reinforced concrete and the abrasive blocks are supported in part from certain of the reinforcing rings centered in the core to hold the segments on the periphery of the core to produce a pulpstone adapted to be rotatably driven in the known type of pulp grinding machine to convert logs into a pulp for the manufacture of paper products and the like.

The abrasive segments can be of any known shape having side edges that can be interfitted to completely cover the peripheral surface and usually the edges of the individual segments are angularly related to produce the best grinding relationship between the ultimate abrasive surface of the pulpstone and the wood being ground. The preferred segments used on this pulpstone are roughly 7" by 12" and are about 5" thick. None of these dimensions, however, are critical.

The segments used in this invention are formed of a known abrasive mix and ceramic bond that is first molded in the usual manner. The specified mix is pressed into the proper shape and is provided with a plurality of holes for the bolts as will be explained more fully below, said holes extending radially inwardly from the grinding face of the segment. The molded segment having a plurality of holes therein extending through the body of the segment is then fired and because the plurality of holes extend entirely through the body it may be fired in the conventional process and the heat will be distributed more rapidly and evenly throughout the body of the mass being fired. This makes for a more uniform and faster firing process.

Figure 1:
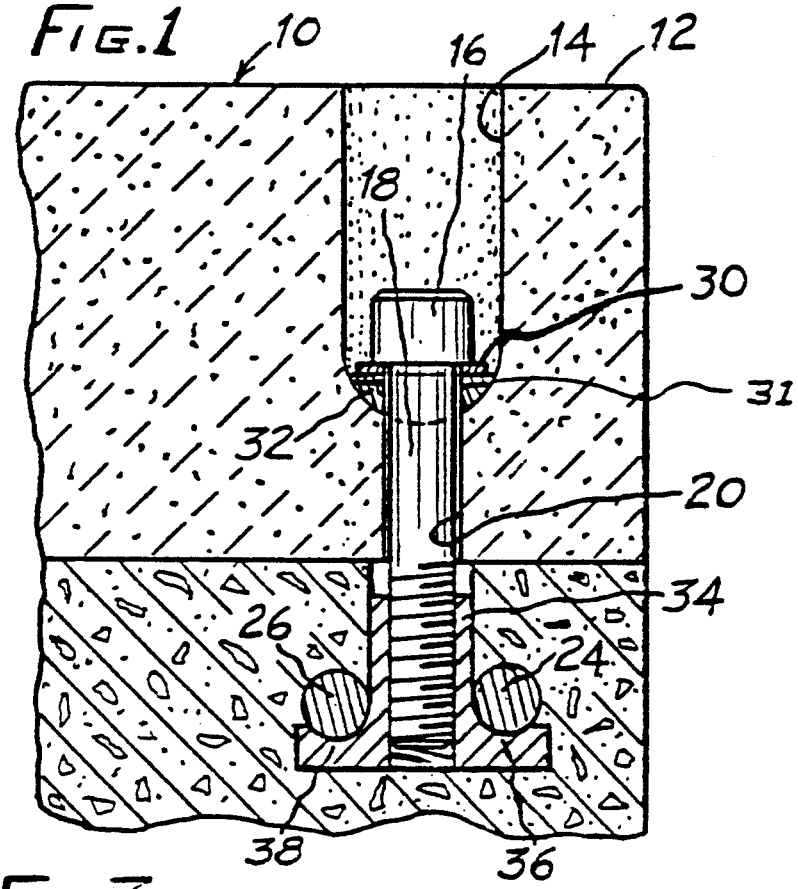
FIG. 1 is a vertical sectional view partly broken away, showing one of the several bolt means and reinforcing ring assemblies used for mounting an abrasive segment on the periphery of a pulpstone, included in the showing is the broken away segment mounted on a cured concrete core.
Figure 3:
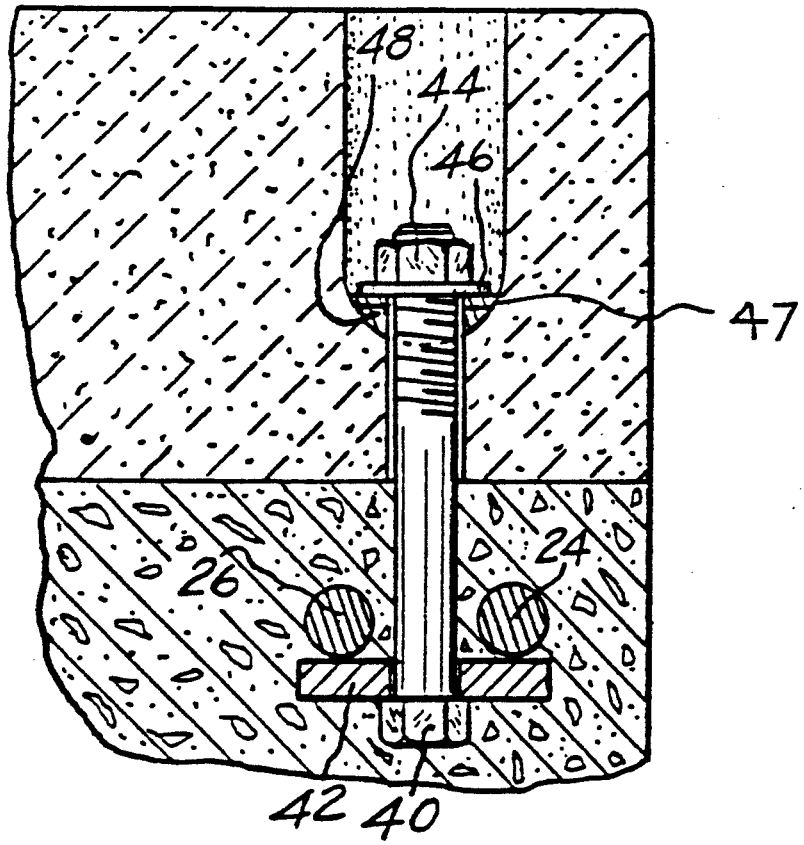
FIG. 3 is a vertical sectional view like FIG. 1 showing an alternate form of bolt and nut arrangement.

Referring to the drawings, a segment 10 that is shown partly broken away is provided, which segment preferably has two or more spaced apart holes to receive bolts as will appear more fully below, one of which holes is shown in FIG. 1. The hole is perpendicular to the grinding surface 12 and is disposed to extend radially inwardly from that surface. The hole has an upper section with a larger diameter 14 at its top end referring to FIG. 1 that is provided for the purpose of receiving the head 16 of a bolt that has a shank portion 18 that fits neatly into the lower section 20 of the hole, which section has a smaller diameter than the upper section 14. As already described above, the seating means or bottom of the upper section 14 of the hole cannot be flat and is preferably concave, filled with a washer 32 of matching configuration, a straight washer 30 and an intermediately located resilient gasket 31. In FIG. 3 the corresponding parts are matching shaped washer 48, straight washer 46, and resilient gasket 47. It should be understood that while only bolts with heads are shown in the drawing, a metal rod threaded on both ends could be used with two nuts.

These segments are made to have the conventional shapes whereby to be assembled in the usual pattern in a chimney for making a pulpstone and thus a plurality of these segments may be fitted together by forming a ring of the end segments in a fixture for holding the segments in a precise position and spaced apart with a conventional rubber-cork gasket or similar compressible material between all the adjacent sides of the abutting segments. When the first ring has been assembled, a second ring of segments is laid precisely on top of the completed ring and the gasket material is put in place between all of the abutting side faces of the segments in that ring. Succeeding rings are similarly precisely aligned with the other segments with the usual gaskets between the segments until the desired pulpstone wheel length has been assembled. This precision assembly of segments may then be fired or baked or otherwise treated to cure the gasket material, to complete the chimney that is then ready for further processing.

When the chimney-like assembly has been baked or otherwise solidified, the outer reinforcing rings for the concrete center that is to be subsequently poured into the center of the chimney, are assembled within the annulus formed by the segments. The outer cage of these reinforcing rings is supported on suitable straps, fixtures or other known means (not shown), two of which rings 24 and 26 are shown spaced on the opposite sides of the nut means and the bolt hole shown in FIG. 1. These rings are held concentrically spaced within the annulus of the assembly of segments and the reinforcing rings are positioned to cooperate with the bolts that are fitted into the plurality of holes in each of the segments. For this reason the reinforcing rings in the outer cage of the reinforcing rings are mounted on their supporting means in closely spaced pairs such as 24 and 26, with the two rings of each of the respective pairs spaced closely to but on the opposite sides of each of the vertical center lines that extend through the centers of all of the holes 14–20.

The view shown in FIG. 1 shows a detailed view of a broken away portion of a segment that is shown in its assembled relationship on the periphery of the concrete center core that has been poured and cured within the annulus of abrasive segments. But before the concrete is poured, and after the rings forming the outer cage of the reinforcing have been set in position, the several bolts 18 can be inserted in their respective holes in each of the segments from the outside of the annulus with a rigid washer 30 with a rigid straight washer, a compressible gasket 31, and a rigid hemi-spherical washer 32 under the head of the bolt. With the rigid straight washer, compressible (resilient) gasket, and rigid hemi-spherical washer shipped onto the bolt, each bolt is pushed through the several sections 14 and 20 of their respective holes so that the inner end of the bolt may be screwed into a cooperating nut means 34. The nut means shown in FIG. 1 is a custom made shape having a central threaded body portion to coact with the threaded bolt means and the body of the nut means each of which has a pair of oppositely facing saddle shaped wings 36 an 38. The wing 36 fits under and is adapted to engage the under side of ring 24 when the bolt is tightened and the wing 38 cooperates with the ring 26 in a similar manner. The bolt shown in FIG. 1 is a cap screw type and may be hand tightened with an Allen wrench that fits into the head of the bolt.

When all of the segments and their respective bolt and nut means have thus been preliminarily assembled together with the outer cage members 24 and 26 of the reinforcing, the bolts can all be carefully torque tightened to the same tension, preferably about 35 foot pounds to produce a tensile stress of 3000 pounds in each bolt. The remaining more centrally disposed reinforcing elements can then be placed in their normal positions and the wet concrete to complete the basic pulpstone structure can then be poured and cured, whereupon the pulpstone is ready for finishing and ultimate use in a pulp grinding machine.

Figure 2:
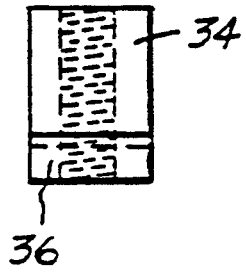
FIG. 2 is a detailed vertical side view taken at 90° with respect to the view in FIG. 1 showing a side view of the nut means for cooperating with the bolt as shown in FIG. 1.

FIGS. 1 and 2 show a custom made nut means for mounting the several segments on the reinforcing rings 24 and 26 but FIG. 3 shows a simpler assembly of bolt means, washers, and conventional nut means. In this disclosure, a standard bolt having a hex head 40 is shown. The bolt engages a washer 42 that seats under the rings 24 and 26 of the outer reinforcing cage. A nut means 44 cooperates with this bolt, there being a washer 46 and a compressible or deformable washer 48 between the nut and the seat in the hole.

When either the nut and bolt means of FIGS. 1 and 2 or the means shown in FIG. 3 is used, a much simpler method of manufacturing a pulpstone is shown as compared with the assembly procedure used heretofore. The herein disclosed bolting system utilized most of the standard techniques but simplifies the assembly operations by eliminating the necessity for preassembly of bolting studs in the threaded holes molded in the bottom sides of the conventionally used segments and the fixtures required for the precision mounting of the studs in the segments, as well as the curing of the cement used for bonding the threaded ends of the studs in the threaded holes of the segments and the necessity for the manufacture of the custom made stud structures themselves. Not only are these savings in the manufacturing procedures realized but there is a saving in the manufacturing equipment needed, and the custom manufacture of the studs. Furthermore, the herein disclosed mounting means for the abrasive segments makes it possible to correct the torque specifications in the wheel on each segment after the concrete is cured, to assure the correct compression stressing of the segments before the pulpstone is put into use and even after it has been in use. It is to be especially noted, that because the threaded engagement of the studs in the molded threads of the holes in the bottoms of the segments as used here-tofore has been entirely eliminated, a stronger attachment of the segments of this invention to the core is achieved. Also cracked or broken segments can be more easily replaced than is possible in pulpstones with concrete cores used today.

This method of building a pulpstone permits compression forces to be built up in the chimney structure or core assembly by the torquing of the bolts before the concrete is poured whereby a more precise adjustment of the stresses in the rim of the wheel can be made. As mentioned above, the proper prestressing of all of the abrasive segments can be assured from time to time while the pulpstone is in use.

While the above describes the preferred form of this invention it is suggested that modifications thereof may occur to those skilled in the art that will fall within the scope of the following claims.

I claim:

1. A grinding stone adapted to be rotatably driven about a centrally disposed bearing means, said stone having an abrasive peripheral surface for preparing wood pulp, said grinding stone including a plurality of spaced abrasive grinding blocks that provide said abrasive surface, said blocks being supported on the periphery of a reinforced poured concrete center core, means to secure said blocks to said periphery of the core, comprising a plurality of radially disposed bolt means, each of said bolt means having a shank and head means, and a nut means for coacting with said bolt means, each of said grinding blocks having at least one bolt hole therein extending from its periphery radially inwardly therethrough, each bolt hole having a seat means for engaging with one of either said head means of said bolt means or nut means of each of said bolt holes providing a passage for surrounding a shank of one of said bolt means, reinforcing means for said concrete core spaced inwardly from said periphery thereof, said reinforcing means being adapted to be engaged by means associated with either said nut means or head means of said bolt means for holding said blocks against said periphery of the core so that when said bolt means are positioned in all of said bolt holes in all of the respective abrasive blocks and said bolt and nut means are tightened together a tension force is produced in each one of said bolt means that in turn produces a compression force in said abrasive blocks situated around the periphery of said core that is sufficient to counteract a substantial portion of the centrifugal force generated in the blocks as said grinding wheel rotates, wherein the improvement comprises a non-flat hole seating means, a rigid non-flat washer the configuration of which matches that of said non-flat hole seating means, a compressible gasket, and a straight rigid washer; said rigid non-flat washer, compressible gasket, and rigid straight washer being located around the bolt in that order in said hole from the hole seating means to the top of the bolt.

2. The grinding stone of claim 1 wherein said non-flat hole seating means is concave.

3. The grinding stone of claim 1 wherein said non-flat hole seating means is conical.

4. The grinding stone of claim 1 wherein said gasket is composed of a material selected from the group consisting of rubber, cork filled rubber, polytetrafluoroethylene, polycarbonate, nylon, polypropylene, and polyethylene.

* * * * *